US008672436B2

(12) United States Patent
Powers et al.

(10) Patent No.: US 8,672,436 B2
(45) Date of Patent: Mar. 18, 2014

(54) METHOD AND SYSTEM FOR IMPROVED INK JET OR PRINTHEAD REPLACEMENT

(75) Inventors: Russell James Powers, Fairport, NY (US); Jan Enderle, Rochester, NY (US); Jeffrey J. Folkins, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 316 days.

(21) Appl. No.: 12/917,543

(22) Filed: Nov. 2, 2010

(65) Prior Publication Data

US 2012/0105529 A1 May 3, 2012

(51) Int. Cl.
*B41J 29/38* (2006.01)
*B41J 29/393* (2006.01)
*B41J 2/015* (2006.01)

(52) U.S. Cl.
USPC ..... 347/14; 347/13; 347/19; 347/20

(58) Field of Classification Search
USPC ..... 347/13–14, 19–20, 42, 44, 47
See application file for complete search history.

(56) References Cited

U.S. PATENT DOCUMENTS 5,124,720 A 6/1992 Schantz
5,371,530 A 12/1994 Hawkins et al.
6,030,072 A 2/2000 Silverbrook
6,231,153 B1 5/2001 Elgee
6,435,668 B1 8/2002 Barbour et al.
6,565,177 B1 5/2003 Corrigan, III
6,676,236 B1 * 1/2004 Uchikata ..... 347/5
7,014,296 B2 3/2006 Silverbrook
7,077,509 B2 7/2006 Parish et al.
7,204,585 B2 4/2007 Bruinsma et al.
7,422,305 B2 * 9/2008 Wada ..... 347/19
7,448,719 B1 11/2008 Newell
7,543,901 B2 6/2009 Snyder et al.
7,735,963 B2 6/2010 Silverbrook
7,762,656 B2 7/2010 Snyder
7,874,662 B2 1/2011 Silverbrook et al.
2005/0156975 A1 * 7/2005 Inoue ..... 347/13
2008/0094455 A1 4/2008 Lee et al.
2008/0266337 A1 * 10/2008 Jackson Pulver et al. ..... 347/8
2009/0135220 A1 5/2009 German et al.
2009/0244172 A1 10/2009 Snyder
2010/0123747 A1 5/2010 McReynolds et al.

* cited by examiner

*Primary Examiner* — Jason Uhlenhake
(74) *Attorney, Agent, or Firm* — Maginot, Moore & Beck, LLP

(57) ABSTRACT

A system and method is provided for compensating for a faulty ink jet in a target printhead in an ink jet imaging system having a plurality of printheads arranged to span a maximum printing width that includes defining a typical printing width less than the maximum printing width and swapping the target printhead with a printhead situated in the margin outside the typical printing width. The system and method permits swapping the target printhead with a margin printhead that has a faulty ink jet provided that the location of the faulty ink jet in the margin printhead does not coincide or align with a faulty ink jet in printheads adjacent the target printhead.

10 Claims, 3 Drawing Sheets

METHOD AND SYSTEM FOR IMPROVED INK JET OR PRINTHEAD REPLACEMENT

TECHNICAL FIELD

This disclosure relates generally to imaging machines that eject ink from printheads or ink jets onto an image substrate and, more particularly, to the replacement of ink jets or printheads in an imaging machine.

BACKGROUND

Drop on demand ink jet technology for producing printed media has been employed in commercial products such as printers, plotters, and facsimile machines. Generally, an ink jet image is formed by selectively ejecting ink drops from a plurality of drop generators or ink jets, which are arranged in a printhead or a printhead assembly, onto an image substrate. For example, the printhead assembly and the image substrate are moved relative to one other and the ink jets are controlled to emit ink drops at appropriate times. The timing of the ink jet activation is performed by a printhead controller, which generates firing signals that activate the ink jets to eject ink. The image substrate may be an intermediate image member, such as a print drum or belt, from which the ink image is later transferred to a print medium, such as paper. The image substrate may also be a moving web of print medium or sheets of a print medium onto which the ink drops are directly ejected. The ink ejected from the ink jets may be liquid ink, such as aqueous, solvent, oil based, UV curable ink or the like, which is stored in containers installed in the printer. Alternatively, the ink may be loaded in a solid form that is delivered to a melting device, which heats the solid ink to its melting temperature to generate liquid ink that is supplied to a print head.

Variations in ink jets may be introduced during print head manufacture and assembly. The variations include differences in physical characteristics, such as ink jet nozzle diameters, channel widths, or lengths, or differences in electrical characteristics, such as thermal or mechanical activation power for the ink jets. These variations may result in different volumes of ink being ejected from the ink jets in response to the same magnitude or same frequency firing signal. To compensate for these differences some previously known printers perform a process to normalize the firing signal for each ink jet within a printhead. Thus, normalizing the electrical firing signals that are used to activate individual ink jets enable all of the ink jets in a printhead to generate ink drops having substantially the same drop mass. In certain instances, an ink jet may fall out of calibration or normalization so that it produces an ink drop that is no longer uniform.

Another issue that arises during operation of an ink jet printer is intermittent, weak, or missing ink jets. Specifically, some ink jets fail either completely or partially so they no longer perform as expected to eject ink onto an image substrate. One method for compensating for such ink jets is disclosed in U.S. Pat. No. 7,021,739 to Burke et al., which is assigned to the assignee of the present application. The method disclosed in that patent disables the inoperative ink jet and uses surrounding ink jets to compensate for the missing, intermittent, or weak ink jet. The printing to be done by the disabled ink jet is performed by one or more of the surrounding ink jets on one or more additional image substrate passes. Thus, this approach slows the printing process because additional substrate passes are required. In another approach described in U.S. Pat. No. 7,448,719 to Roger Newell, which is also assigned to the assignee of the present application, a second or back-up printhead is shifted laterally relative to the substrate so that a properly functioning ink jet is aligned with the defective ink jet along the process direction. In another approach, described in U.S. Pat. No. 7,021,739 assigned to the assignee of the present application, partial nozzle redundancy is used to account for an impaired nozzle. In this approach, the normal ejection output for neighboring nozzles is increased so that the pixels to be printed by the impaired nozzle are printed by neighboring nozzles at previously blank pixels. While these approaches provide temporary relief from a defective ink jet it is still necessary to replace the defective ink jet or printhead.

The replacement of a defective ink jet or printhead can involve significant down time. A new printhead for a solid ink printing machine requires a warm-up time to not only be brought up to the machine operating temperature but to also be sufficiently warmed up to function properly. Failure to be properly warmed up can lead to intermittent missing jets for a printhead. This phenomenon can often be attributed to the process of heating a printhead from cold to the operating temperature, which can cause the ink inside to undergo a phase transition and volume change. This change in the ink can create bubbles and voids in the molten ink within the printhead that can require purging. However, even several purge cycles will not always eliminate air bubbles or voids. Additionally, even after the ink is brought to its operating temperature, bubbles and voids can occur if the ink has not been maintained at this temperature for a sufficient time, thereby resulting in missing jets. Consequently, the current practice is to implement a significant warm-up time for a newly installed replacement printhead, followed by one or more purge cycles before the printing machine is brought on-line. This can result in several minutes of down-time, especially for printing machines have a large number of print heads.

SUMMARY

According to aspects illustrated herein, there is provided a method for compensating for a faulty ink jet in a target printhead in an ink jet imaging system having a plurality of printheads arranged to span a maximum printing width, the method comprising defining a typical printing width less than the maximum printing width, determining if the target printhead having the faulty ink jet is situated within the typical printing width, and if so then swapping the target printhead with a printhead situated in the margin outside or partially outside the typical printing width.

In a further aspect, the swapping step includes evaluating the printheads situated in the margin to identify a margin printhead that does not have a faulty ink jet, and swapping the margin printhead with the target printhead. If no such margin printheads are identified, then the method contemplates identifying the location of any faulty ink jet in a margin printhead, evaluating a printhead within the typical printing width that is successive and adjacent to the target printhead to identify the location of any faulty ink jet in the adjacent printhead, comparing the location of any faulty ink jet of the margin printhead with the location of any faulty ink jet of the adjacent printhead, and if the location of any faulty ink jet of the margin printhead is not aligned along the process direction of the ink jet imaging system with any faulty ink jet of the adjacent printhead, then swapping the margin printhead with the target printhead.

In another aspect, a method for compensating for a faulty ink jet in a target printhead in an ink jet imaging system having a plurality of printheads comprises identifying the location of any faulty ink jet in the target printhead, selecting a swap printhead to swap with the target printhead, evaluating a printhead that is successive and adjacent to the swap printhead to identify the location of any faulty ink jet in the adjacent printhead, comparing the location of any faulty ink jet of the target printhead with the location of any faulty ink jet of the adjacent printhead, and if the location of any faulty ink jet of the target printhead is not aligned along the process direction of the ink jet imaging system with any faulty ink jet of the adjacent printhead, then swapping the target printhead with the swap printhead.

A printing station for an ink jet imaging system is disclosed comprising a plurality of printheads arranged across a maximum printing width, each having a plurality of ink jets, and a controller having a display for displaying information and configured for controlling the operation of the plurality of printheads to define a typical printing width less than the maximum printing width and a margin outside the typical printing width, identify a target printhead having a faulty ink jet and determining if the target printhead is situated within the typical printing width, if so then identifying a margin printhead within the margin to be swapped with the target printhead, and providing an indicator on the display identifying the target printhead and the margin printhead to be swapped with the target printhead.

DETAILED DESCRIPTION

Figure 1:
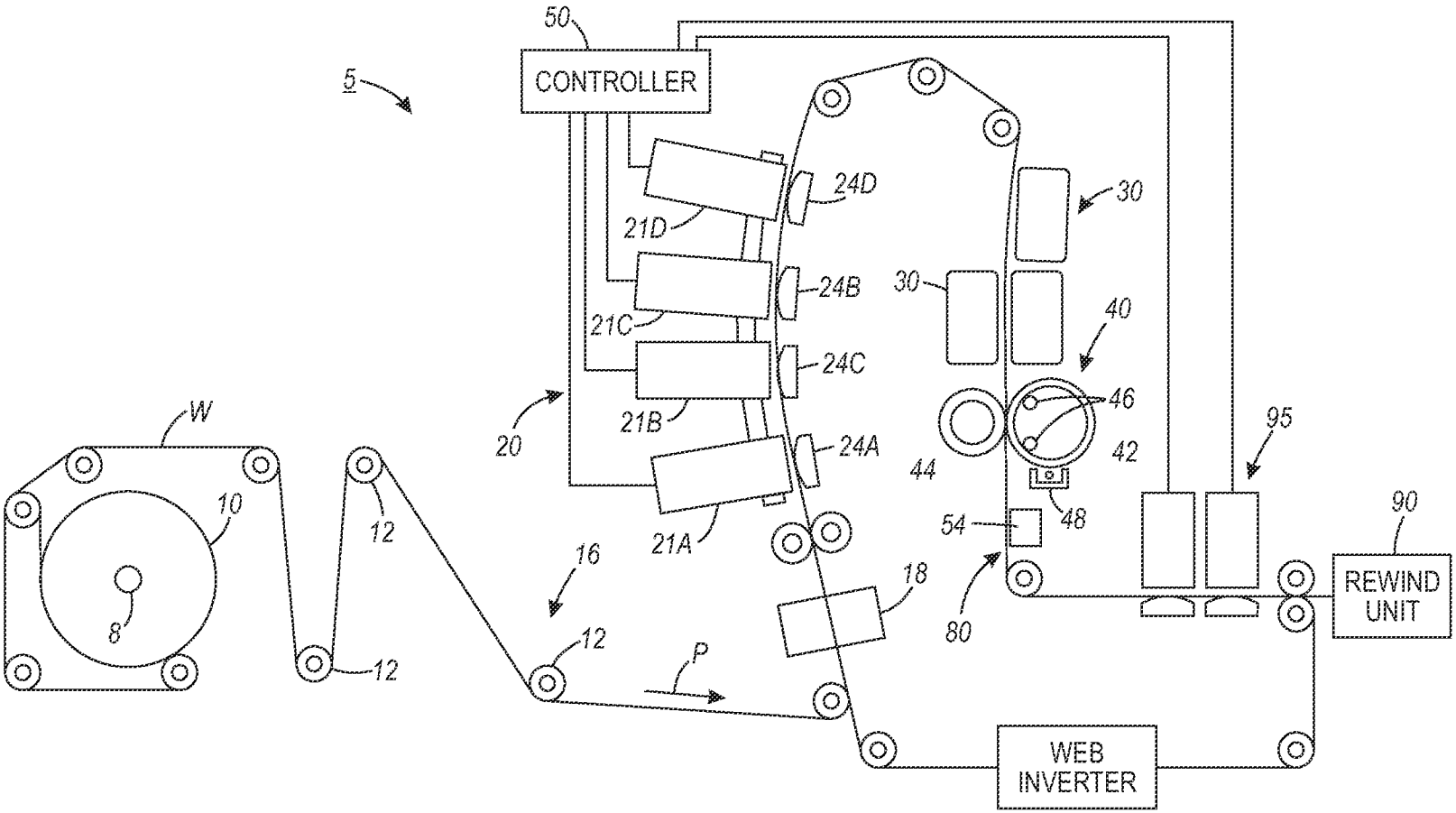
FIG. 1 is a schematic view of an ink jet imaging machine that ejects ink onto a continuous web of media as the media moves past the printheads in the machine.

Referring to FIG. 1, an ink jet imaging system 5 is shown. For the purposes of this disclosure, the imaging apparatus is in the form of an ink jet printer that employs one or more ink jet printheads and an associated solid ink supply. The exemplary direct-to-sheet, continuous-media, phase-change ink jet imaging system 5 includes a media supply and handling system configured to supply a long (i.e., substantially continuous) web of media W of "substrate" (paper, plastic, or other printable material) from a media source, such as spool of media 10 mounted on a web roller 8. For simplex printing, the printer may include a feed roller 8, media conditioner 16, printing station 20, printed web conditioner 80, coating station 95, and rewind unit 90. For duplex operations, a web inverter may be used to flip the web over to present a second side of the media to the printing station 20. In the simplex operation, the media source 10 has a width that substantially covers the width of the rollers over which the media travels through the printer.

The media may be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The preheater 18 may use contact, radiant, conductive, or convective heat to bring the media to a target preheat temperature, which in one practical embodiment, is in a range of about 30° C. to about 70° C.

The media is transported through a printing station 20 that includes a series of color units 21A, 21B, 21C, and 210, each color unit effectively extending across the width of the media and being able to place ink directly (i.e., without use of an intermediate or offset member) onto the moving media. The color units include an arrangement of printheads in the print zone of system 5 as discussed in more detail with reference to FIG. 2. As is generally familiar, each of the printheads may eject a single color of ink, one for each of the colors typically used in color printing, namely, cyan, magenta, yellow, and black (CMYK). A controller 50 generates timing signals for actuating the ink jet ejectors in the printheads in synchronization with the passage of the media W to enable the four colors to be ejected with a reliable degree of accuracy for registration of the differently colored patterns to form four primary-color images on the media. The ink jet ejectors are actuated by the firing signals to correspond to image data processed by the controller 50 that may be transmitted to the printer, generated by a scanner (not shown) that is a component of the printer, or otherwise generated and delivered to the printer. In various possible embodiments, a color unit for each primary color may include one or more printheads; multiple printheads in a color unit may be formed into a single row or multiple row array; printheads of a multiple row array may be staggered; a printhead may print more than one color; or the printheads or portions of a color unit may be mounted movably in a direction transverse to the process direction P, such as for spot-color applications and the like.

Each of color units 21A-210 may include at least one actuator configured to adjust the printheads in each of the printhead modules in the cross-process direction across the media web. In a typical embodiment, each motor is an electromechanical device such as a stepper motor or the like. In a practical embodiment, a print bar actuator is connected to a print bar containing two or more printheads and is configured to reposition the print bar by sliding the print bar along the cross-process axis of the media web. In alternative embodiments, an actuator system may be used that does not physically move the printheads, but redirects the image data to different ejectors in each head to change head position. Such an actuator system, however, can only reposition the printhead in increments of at least the cross process direction ejector to ejector spacing.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. As used herein, liquid ink refers to melted solid ink, heated gel ink, or other known forms of ink, such as aqueous inks, ink emulsions, ink suspensions, ink solutions, or the like.

Associated with each color unit is a backing member 24A-24D, typically in the form of a bar or roll, which is arranged substantially opposite the color unit on the back side of the media. Each backing member is used to position the media at a predetermined distance from the printheads opposite the backing member. Each backing member may be configured to emit thermal energy to heat the media to a predetermined temperature.

Following the printing zone 20 along the media path are one or more "mid-heaters" 30. A mid-heater 30 may use contact, radiant, conductive, and/or convective heat to control a temperature of the media and particularly to bring the media to a temperature suitable for desired properties when passing through the spreader 40. A fixing assembly in the form of the "spreader" 40 is configured to apply heat and/or pressure to the media to fix the images to the media. The function of the spreader 40 is to take what are essentially droplets, strings of droplets, or lines of ink on web W and smear them out by pressure and, in some systems, heat, so that spaces between adjacent drops are filled and image solids become uniform. The spreader 40 may include rollers, such as image-side roller 42 and pressure roller 44, to apply heat and pressure to the media, either of which can include heating elements, such as heating elements 46, to bring the web W to a predetermined temperature. The spreader 40 may also include a cleaning/oiling station 48 associated with image-side roller 42. The station 48 cleans and/or applies a layer of some release agent or other material to the roller surface. A coating station 95 applies a clear ink to the printed media to modify the gloss and/or to help protect the printed media from smearing or other environmental degradation following removal from the printer.

Operation and control of the various subsystems, components and functions of the imaging system 5 are performed with the aid of the controller 50. The controller 50 may be implemented with general or specialized programmable processors that execute programmed instructions. Controller 50 may be operatively coupled to the print bar and printhead actuators of color units 21A-21D in order to adjust the position of the print bars and printheads along the cross-process axis of the media web. In particular, the controller may be operable to shift one or more, or all, of the color units laterally or transverse to the process direction P.

The imaging system 5 may also include an optical imaging system 54 that is configured in a manner similar to that for creating the image to be transferred to the web. The optical imaging system is configured to detect, for example, the presence, intensity, and/or location of ink drops jetted onto the receiving member by the ink jets of the printhead assembly. The imaging system may incorporate a variety of light sources capable of illuminating the printed web sufficient to detect printing errors that may be attributable to a faulty or defective ink jet or printhead. The imaging system 54 further includes an array of light detectors or optical sensors that sense the image reflected from the printed web prior to discharge. The controller 50 analyzes the information from the imaging system 54 to determine, among other things, whether a failure or an ink jet or printhead has occurred. The location of the defective printing element is identified and made available to the maintenance technician during a diagnosis procedure. The controller 50 may also use the data obtained from the imaging system 54 to adjust the registration of the color units such as by moving a color unit or one or more printheads. This image data may also be used for color control.

Figure 2:
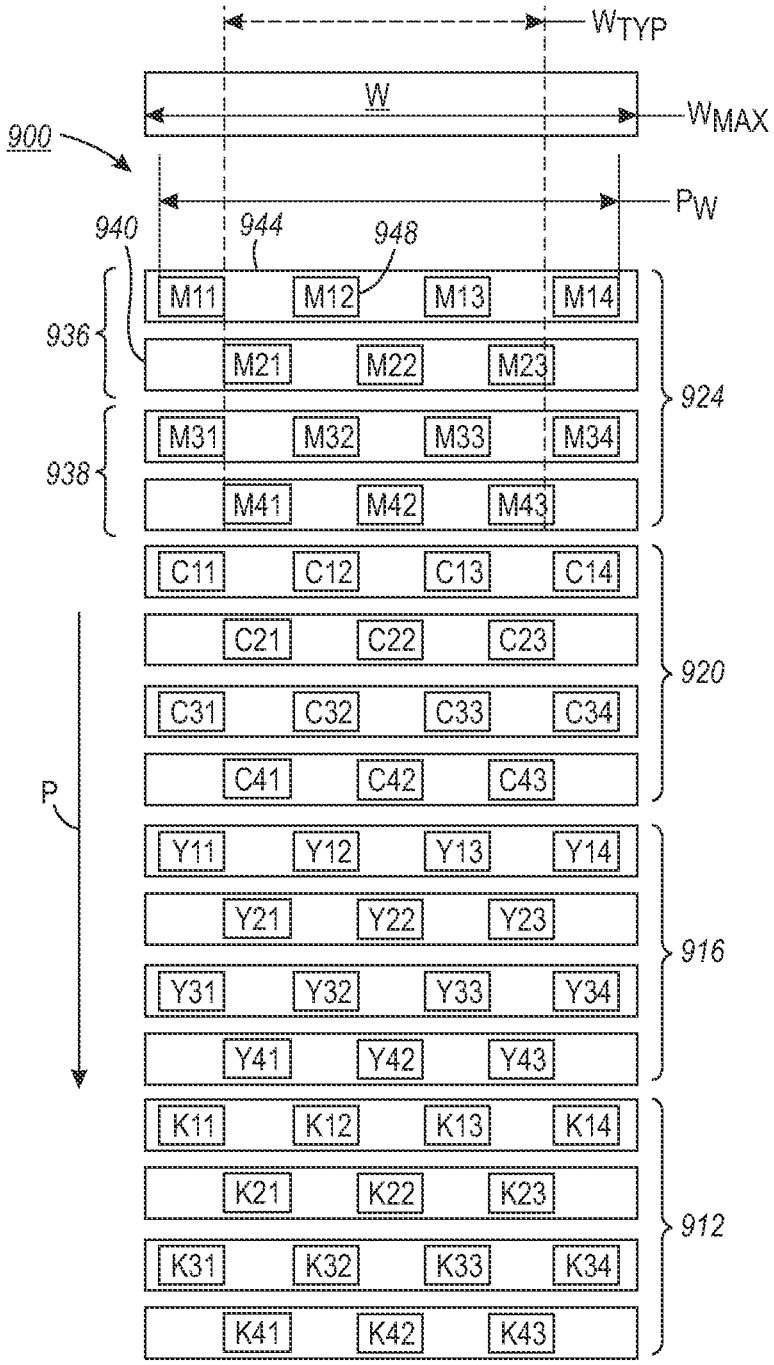
FIG. 2 is a schematic view of a printhead configuration for an imaging machine such as the machine shown in FIG. 1.

A schematic view of a print zone 900 embodied by the printhead arrays 21A-210 is shown in FIG. 2. In the illustrated embodiment the print zone 900 includes four color units 912, 916, 920, and 924 arranged along a process direction P, although fewer or additional color units may be provided. Each color unit ejects ink of a color that is different than the other color units. In one embodiment, color unit 912 ejects black ink, color unit 916 ejects yellow ink, color unit 920 ejects cyan ink, and color unit 924 ejects magenta ink. Process direction P is the direction that an image receiving member W moves as the member travels past each printhead array or under the color units from color unit 924 to color unit 912.

As shown in FIG. 2, each color unit includes two print bar arrays, each of which includes two print bars that carry multiple printheads. For example, the print bar array 936 of magenta color unit 924 includes two print bars 940 and 944, each carrying a plurality of printheads. For instance, print bar 940 has three printheads (M21, M22 and M23), while print bar 944 has four printheads (M11, M12, M13 and M14), although alternative print bars may employ a greater or lesser number of printheads. The printheads on the print bars within a print array, such as the printheads on the print bars 940 and 944, are staggered to provide printing across the width of image receiving member in the cross process direction at a first resolution. Within color unit 924 the printheads of the print bar array 936 are interlaced with reference to the printheads of the print bar array 938 to enable printing in the colored ink across the width of the image receiving member in the cross process direction at a second resolution. The print bars and print bar arrays of each color unit are arranged in this manner. Moreover, in certain embodiments one print bar array in each color unit is aligned with one of print bar array in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

As shown in FIG. 2, the print zone 900 created by the color units 912, 916, 920 and 924, spans a width $P_W$. This width is suitable for printing on a web having a maximum width $W_{MAX}$. Thus, in a specific example, the individual printheads M11, M12, etc., have a width of about 2.93 in. With the seven staggered printheads in each print bar array (such as in array 936), the total width is about 20.5 in. Thus, the color units can effectively cover a web W having a maximum width $W_{MAX}$ of about 20.5 in.

However, in many, even most, instances, the printing customer does not require a web or a printing width of 20.5 in. Instead, the typical customer might print to a maximum sheet width $W_{TYP}$ of 17 in., and in some cases widths of about 12 in. (for A4 size) or less. Consequently, for the typical print job, the outermost printheads, such as printheads M14, M34, C14 and C34 in FIG. 2, will not be activated during a printing cycle since the sheet width $W_{TYP}$ does not extend to the edges of the print zone 900—i.e., $W_{TYP}$ is less than $P_W$. However, regardless of whether the outermost printheads are activated they are always ready for printing, which means that the printheads and ink within are maintained at the operating temperature of the machine.

As described above, ink jets or printheads fail to print properly for a variety of reasons. The controller 50 may be configured to perform self-diagnostic routines that continually evaluate print quality to thereby ascertain whether and where a defect might have arisen. In a diagnostic mode of operation of the machine 10, the controller 50 identifies the location of the defect for the maintenance technician. The technician removes the defective printhead and replaces it with a new or refurbished printhead. In the traditional machine maintenance cycle, the machine would then need to be operated in a warm-up and purge cycle to ready the newly installed printhead for operation.

In accordance with the present disclosure, rather than replace the defective printhead with a separately provided printhead, the maintenance technician exchanges the identified defective printhead with a printhead taken from the side margin of the printing area 900. For instance, referring to FIG. 2, if the printhead M12 is identified as faulty, it can be replaced by either printhead M14 or M34 since they fall within the print area margin outside the typical sheet width $W_{TYP}$. This replacement printhead is already warmed up, charged with ink and purged so that no additional maintenance run time is required to prepare the replacement printhead for normal operation. Moreover, since the replacement printhead has been operating within the machine for a period of time, it will have "settled in" with respect to the ink jet calibrations that tend to drift when a printhead is new and will have a lower propensity to allow jets to fail.

The removed printhead can either be swapped into the position of the replacement printhead—i.e., at the margin of the print area 900—or removed from the machine for repair and/or refurbishing. In the latter case, a new printhead may be installed in the margin location. This new printhead will then undergo the normal warm-up, purge and burn in cycle of the machine as it is used in the ordinary course.

In the former case, a determination may be made as to an optimum swap position for the faulty printhead. In other words, a determination can be made as to which location at the margin of the print area would be affected least by the faulty printhead. For instance, if a printhead has a defective ink jet at the right side of the printhead, swapping the faulty printhead with a printhead on the right margin of the print area 900 may be preferable so that the defective ink jet is aligned with a non-printing zone. Similarly, if the defective ink jet is on the left side of the printhead, swapping with a printhead in the left margin, such as printheads M11 or M31 in the above example, might be preferred. Moreover, the swap location determination may take into account the presence of faulty printheads or defective ink jets already in the margins of the print area 900. For instance, if it is known that the ink jet M14 has one or more defective ink jets, the optimum swap may not be with the sequential printhead M34, but rather with a printhead on the opposite side of the print area, namely printhead M11 or M31.

In a further level of refinement, a determination can be made as to the specific location of defective ink jets. In certain machines, the controller 50 is operable to account for a defective or missing ink jet by controlling compensating operation of adjacent ink jets. One example of this approach is found in U.S. Pat. No. 7,448,719, identified above, the disclosure of which is incorporated herein by reference. Other compensating algorithms are known for controlling the operation of functioning ink jets to at least partially compensate for a defective or missing ink jet. However, each approach relies upon the availability of close neighboring ink jets, either on the head itself or on the sequential head of the same color, to account for the missing jet. In the present instance, it can be contemplated that over time several printheads may reside in the margins of the print area 900 that include one or more defective ink jets. Thus, in the further refinement to the present process, a determination is made as to whether the defective ink jet location of a soon-to-be swapped printhead will frustrate the compensation algorithms. In other words, the replaced printhead is swapped to a location where: a) it is less likely to be used in a print operation; and b) it will still be able to compensate for defective ink jets in other printheads.

This same determination may be necessary for the printhead being moved from the margin to replace the faulty printhead. In the ideal circumstance, the replacement printhead obtained from a margin position is fully-functional with no defective or missing ink jets. However, over the life of the printing machine 10, many printhead swaps may occur, which means that all the printheads at the margins have at least one defective ink jet. However, the presence of a defective jet does not mean that the swap should not be made or that a new printhead is required. As above, a determination can be made as to whether a defective ink jet in a printhead to be swapped can be compensated by adjacent ink jets in the standard print field. For instance, if the faulty printhead is M12 is to be replaced and it is known that the sequential printhead M32 is intact with no defective ink jets, then any of the margin printheads (M14, M34, M11 or M31) may be swapped even if they include a defective jet. However, if it is known that printheads M32 and M34 each have a defective jet at the same or close pixel location, then it can be determined that the printhead M34 cannot be swapped with the existing faulty printhead M12.

In many printing machines, the web or substrate may be registered in different ways relative to the printhead array. For instance, the web may be center registered, as depicted in FIG. 2, so that the printing width $W_{TYP}$ of the web is essentially centered between the sides of the printhead array. In the example of a 20.5 in. printhead array width and a 17 in. width paper, the side margins would be limited to 1.75 in. each. This width margin width may not be sufficient to accommodate the width of a single printhead, which in the above examples can be about 2.93 in. However, if the faulty ink jet on the printhead being swapped is offset to one side or the other, as discussed above, this reduced width may still be sufficient to ensure that the faulty jet is outside the typical printing width (i.e., within the 1.75 in. margin).

On the other hand, many machines implement or are capable of side registration in which the web or sheet is registered to one side or the other of the printing array. In the present example, for a side registered web, the margin width would be about 3.5 in., which is sufficient to accommodate the entire 2.93 in. printhead width. Some machines have the capability to change the registration as desired between center and side registration. In those types of machines, the approach described herein may include enabling side registration with the web specifically shifted to the margin occupied by the target printhead being swapped, as described above.

The controller 50 is configured to make the above-described determinations automatically when a defective printhead is detected. Thus, the controller 50 may include a software routine that follows the decision path shown in FIG. 3. The sequence of steps commences with the detection of a faulty printhead in step 1000. A determination is then made in step 1010 whether the faulty printhead is within the typical print area $W_{TYP}$. If not then the controller displays in step 1020 a recommendation that no replacement is required. If the faulty printhead is already in a side margin of the print area 900 there is no benefit to swapping the faulty printhead with another printhead at any location in the print area 900. Optionally, the process flow may evaluate whether the new fault creates problems with sequentially adjacent printheads, as described below, so the process flow may pass to step 1150.

If the faulty printhead is within the typical printing area $W_{TYP}$, the location or pixel of any defective ink jets in the faulty printhead are identified in step 1030. This identification can be made in any manner currently known or that may be developed. The location of the defective or missing ink jet may be isolated to the left or right side of the printhead in step 1040, and the potential swap printheads on the corresponding side margin of the print area and for the same color unit as the faulty printhead are identified in either step 1050 or 1055. For instance, if the faulty printhead is M12 and a determination is made that the defective or missing jet is on the right side of the printhead, then the process would identify printheads M14 and M34 in step 1055.

It can be noted that for a side registered web—i.e., a web that is shifted to one side or the other—it may not be necessary to isolate whether the defective jet is on the left or right side of the printhead. In this case, steps 1050 and 1055 can devolve into simply identifying printheads of the same color unit that reside on the margin resulting from the side registered web.

Once the printheads (M14 and M34) have been identified that may be swapped for the faulty printhead (M12), the potential swap printheads are evaluated to determine if there are any that do not have a defective or missing ink jet. Once that subset of potential swap printheads has been identified, the process advances in step 1070 to assess whether swapping the faulty printhead will create new problems with the sequentially adjacent printheads at the margin. Thus, in step 1080 a determination is made whether any printhead adjacent the potential swap printhead has a defective or missing jet at the same location as in the faulty printhead to be replaced. If not, meaning that there are no compensation problems, then the controller 50 recommends in step 1090 to swap the faulty printhead with the identified printhead occupying a margin position in the print area 900. Thus, in the present example, if printhead M14 is the potential swap printhead, the controller 50 looks at the adjacent printhead M34 to determine whether it has a defective ink jet at the same location as the faulty printhead M12 being replaced. If the adjacent printhead is intact, then the controller issues a notice to the maintenance technician to swap printheads M12 (the faulty printhead) and M14 (the replacement printhead).

In step 1080, if it is instead determined that the potential swap printhead does have a same-location defective or missing ink jet, then a determination is made in step 1100 whether there are any other potential printhead swaps without defective jets that had been identified in step 1060. This sequence of steps continues until all potential intact margin printheads have been evaluated for their "swap-worthiness". If there are none then the controller may proceed to step 1090 in which the current potential swap is recommended. It can be understood that in this instance although a printhead having no defective jets is replacing the faulty printhead, the swap will result in printheads at the margin of the print area 900 having defective or missing ink jets at adjacent aligned locations. However, since the faulty printheads are limited to the print area margins the potential for image defects is much reduced. Alternatively, if no intact or defect-free printhead can be identified that meets the requirements of step 1080, the process may transfer to step 1150 to search for a potential swap printhead that has a defective ink jet.

If a determination is made in step 1060 that there are no intact swap printheads (i.e., having no defective or missing ink jets), then the potential swap printheads are identified in step 1150. It is understood that in this loop of the process the margin printheads under consideration are known to have a defective or missing ink jet. The determination to be made is whether this defective ink jet position will introduce an error into the main print field ($W_{TYP}$) that cannot be resolved using compensation algorithms or other techniques as discussed above. Thus, in step 1160, the printheads adjacent the faulty printhead to be replaced are examined. In the present example in which the faulty printhead is printhead M12, the controller would evaluate printhead M32 which is the next adjacent printhead that would be operated to compensate for any defective ink jet near the M12 location. If printhead M32 has no defective jet, then there is no risk to making the swap of a printhead identified in step 1150.

Once all the potential swap printheads have been identified that meet the criterion of step 1160, the process continues to steps 1070 and 1080 to select among the identified potential swap printheads and make a final recommendation. On the other hand, if no printheads can be identified in step 1160 then the controller issues a recommendation to the maintenance technician in step 1180 that a new printhead is required. In other words, by the time the process has advanced to step 1180, the controller has determined that: a) there are no printheads in the margin locations that have no defective or missing ink jets; b) consequently, all of the printheads that could potentially be swapped for the faulty printhead have one or more defective ink jets; and c) the location of the defective ink jets in each of the potential swap printheads would defeat the compensation features of the controller.

On the other hand, if the controller 50 makes a recommendation in step 1090, the controller has determined that: a) there is at least one printhead in a margin location that is intact with no defective or missing ink jets; and b) swapping the faulty printhead with this potential swap printhead will not defeat the compensation features of the controller with respect to the printheads in the margins of the print area 900.

The present process thus contemplates several printhead swaps over the life of the printheads. Obviously, at some point any particular printhead will require replacement with a new printhead. But, while the printhead retains enough functionality it can be moved to a position at the margins of the print area that are outside the normal printing region $W_{TYP}$ for the majority of the print jobs for the machine. Since the printhead swaps are being made between printheads already loaded within the machine, there is no additional down time required to bring the machine back online once a printhead swap has been made.

Figure 3:
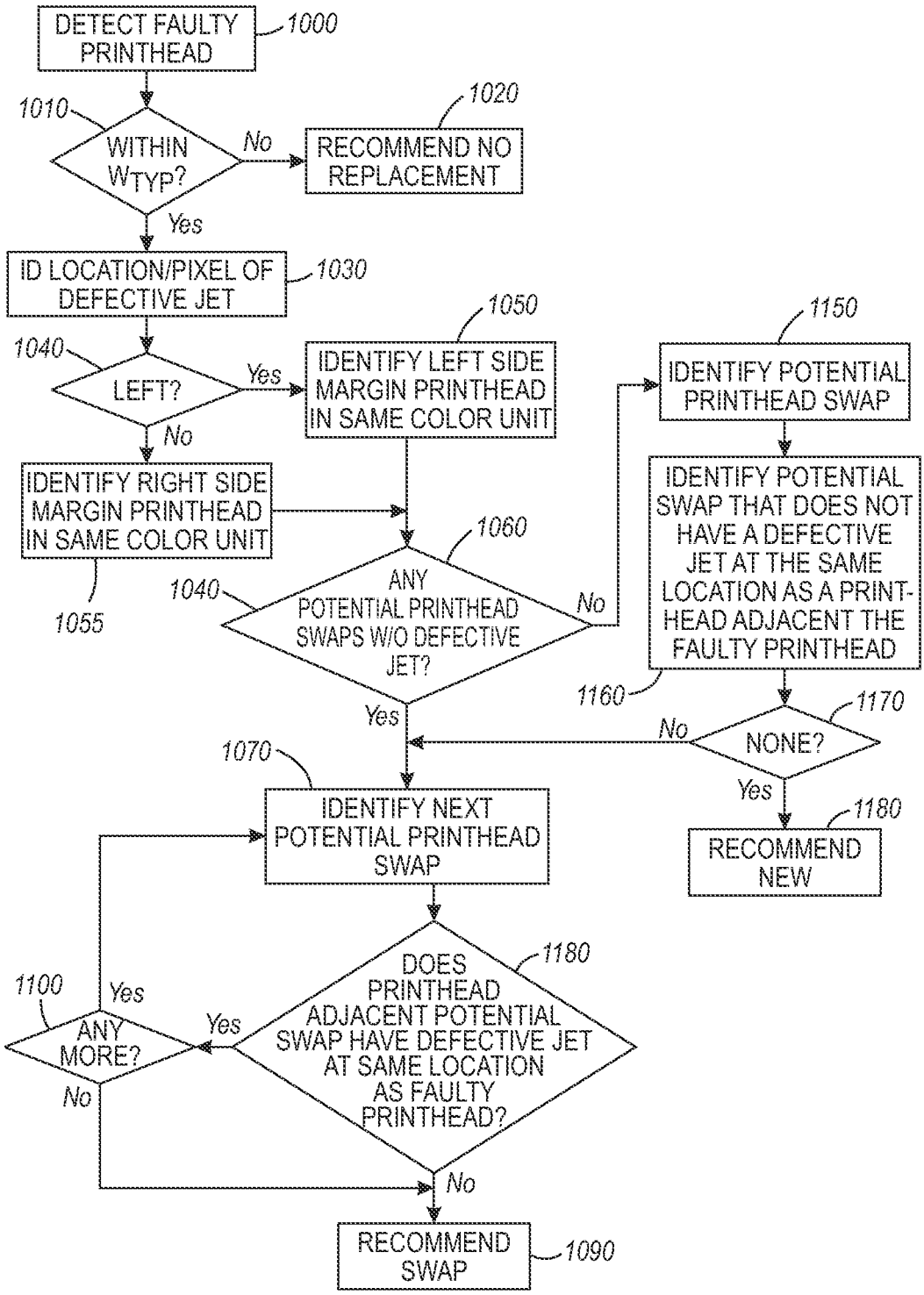
FIG. 3 is a flow diagram of a method for determining swap locations for a faulty printhead.

The controller 50 of the imaging system 5 may be configured to execute the decision steps set forth in the flowchart of FIG. 3, such as by software resident in the controller. As described above, the controller may also implement self-diagnostic routines during the start-up and/or continuous operation of the system 5 to identify the location of a defective ink jet. In prior systems, once a printhead with a defective jet has been identified, it is replaced with a new printhead. However, in accordance with the system and method disclosed herein, the faulty printhead is not removed from the imaging system but is instead replaced with another printhead from within the same system. The controller 50 must have some "awareness" of the identity and condition of all of the printheads in the system, and more particularly knowledge of the location of any faulty jets within a printhead.

It is thus contemplated that each printhead is assigned a unique identifier and that the controller 50 maintains a database of printhead information. That information may include the printhead identifier and an indication of which ink jets, if any, are faulty. This indication may correspond to the pixel position(s) served by the faulty ink jet. When performing the analysis in the flowchart of FIG. 3, the controller may make a pixel-to-pixel comparison when evaluating whether a particular printhead swap can be made. For instance, in step 1030 the pixel location of the defective jet in the printhead to be moved from the typical print area $W_{TYP}$ is identified. In step 1080 the printhead database is queried for the potential swap printhead to determine whether the pixel identified in step 1030 is faulty in the swap printhead. The same type of comparison can be made in step 1160.

It can be appreciated that the system and method described herein can also be used to perfect a swap of printheads that are both within the typical print area $W_{TYP}$. In this instance, steps 1040, 1050 and 1055 may be bypassed since the swap printhead need not be obtained from the left or right side margins. The remaining steps 1060-1170 may proceed as described, cycling through all of the other printheads of the same color unit, whether or not the printhead is at a margin. For each printhead the controller evaluates whether there is a concurrence of faulty pixel(s) between the two printheads to be potentially swapped. If no swap printhead can be identified then the controller recommends a new printhead in step 1180. Alternatively, other faulty ink jet compensation schemes may be implemented, such as the approach described in U.S. Pat. No. 7,338,144 discussed above, the disclosure of which is incorporated herein by reference.

It can be further appreciated that the systems and methods described herein may be utilized to identify target printheads that are situated partially within the typical printing width but have faulty ink jets that are situated within the typical printing width. Similarly, the margin printhead being identified to swap with the target printhead may be situated partially in the margin outside the typical printing width.

The systems and methods disclosed herein may be utilized to eliminate all faulty ink jets from within an image area, particularly an image area defined within the typical printing width. In this instance, any margin printhead being swapped with a target printhead must be free of faulty ink jets, otherwise the system will recommend replacing the target printhead with a new printhead. In other cases, the systems and methods disclosed herein can be used to augment existing techniques for accounting for faulty inkjets, such as the neighboring pixel technique described above. In these cases, it is accepted that faulty ink jets may exist within the image area, but acknowledged that the known techniques will avoid any detrimental effects on the final printed image. Thus, in this case the systems and methods disclosed herein essentially optimize the use of all the printheads to prevent two or more neighboring or close neighboring pixels (ink jets) from being faulty.

It will be appreciated that various of the above-described features and functions, as well as other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A method for compensating for a faulty ink jet in a target printhead in an ink jet imaging system having a plurality of printheads arranged to span a maximum printing width in which the plurality of printheads are center registered, each printhead having a plurality of ink jets, the method comprising the steps of:

defining a typical printing width less than the maximum printing width;

determining if the target printhead having the faulty ink jet is situated at least partially within the typical printing width and if the faulty ink jet is situated at the left side or right side of the target printhead; and if so then swapping the target printhead with a printhead from the plurality of printheads that is situated in a left or right margin at least partially outside the typical printing width corresponding to the left or right side location of the faulty ink jet.

2. The method for compensating for a faulty ink jet of claim 1, wherein the swapping step includes:

evaluating the printheads of the plurality of printheads that are situated at least partially in the margin to identify a margin printhead that does not have a faulty ink jet; and if no such margin printheads are identified, then;

identifying the location of any faulty ink jet in a margin printhead;

evaluating a printhead within the typical printing width that is successive and adjacent to the target printhead to identify the location of any faulty ink jet in the adjacent printhead;

comparing the location of any faulty ink jet of the margin printhead with the location of any faulty ink jet of the adjacent printhead; and if the location of any faulty ink jet of the margin printhead is not aligned along the process direction of the ink jet imaging system with any faulty ink jet of the adjacent printhead, then swapping the margin printhead with the target printhead.

3. The method for compensating for a faulty ink jet of claim 2, wherein if the location of the faulty ink jets are aligned, the identifying, evaluating and comparing steps are repeated for another margin printhead.

4. The method for compensating for a faulty ink jet of claim 1, in which the plurality of printheads are provided in two or more color units, and wherein the swapping step includes only swapping the target printhead with a margin printhead in the same color unit.

5. A method for compensating for a faulty ink jet in a target printhead in an ink jet imaging system having a plurality of printheads arranged to span a maximum printing width, each printhead having a plurality of ink jets, the method comprising the steps of:

defining a typical printing width less than the maximum printing width;

determining if the target printhead having the faulty ink jet is situated at least partially within the typical printing width; and if so then swapping the target printhead with a printhead from the plurality of printheads that is situated in the margin at least partially outside the typical printing width, wherein the swapping step includes;

evaluating the printheads of the plurality of printheads that are situated at least partially in the margin to identify a margin printhead that does not have a faulty ink jet; and swapping the margin printhead with the target printhead.

6. A printing station for an ink jet imaging system comprising:

a plurality of printheads arranged across a maximum printing width, each having a plurality of ink jets, wherein the plurality of printheads are center registered; and a controller having a display for displaying information and configured for controlling the operation of the plurality of printheads to apply an ink image on a substrate and further configured to;

define a typical printing width less than the maximum printing width and a left and a right margin outside said typical printing width;

identify a target printhead having a faulty ink jet and determining if said target printhead is situated at least partially within the typical printing width and if the faulty ink jet is situated at the left side or right side of the target printhead;

if so then identify a margin printhead of said plurality of printheads that is at least partially within the left or right margin corresponding to the left or right side location of the faulty ink jet, to be swapped with said target printhead; and provide an indicator on said display identifying said target printhead and said margin printhead to be swapped with said target printhead.

7. The printing station of claim 6, wherein said controller is further configured to evaluate the printheads of said plurality of printheads that are situated at least partially in the margin to identify a margin printhead that does not have a faulty ink jet.

8. The printing station of claim 6, said controller is further configured to:

evaluate the printheads of said plurality of printheads that are situated at least partially in the margin to identify a margin printhead that does not have a faulty ink jet; and if no such margin printheads are identified, then;

identify the location of any faulty ink jet in a margin printhead;

evaluate a printhead within the typical printing width that is successive and adjacent to said target printhead to identify the location of any faulty ink jet in the adjacent printhead;

compare the location of any faulty ink jet of the margin printhead with the location of any faulty ink jet of the adjacent printhead; and if the location of any faulty ink jet of the margin printhead is not aligned along the process direction of the ink jet imaging system with any faulty ink jet of the adjacent printhead, then identify said margin printhead to be swapped with said target printhead.

9. The printing station of claim 8, said controller is further configured to repeat the identifying, evaluating and comparing steps for another margin printhead if the location of the faulty ink jets are aligned.

10. The printing station of claim 6, wherein:

said plurality of printheads are provided in two or more color units; and said controller is configured to only identify a margin printhead in the same color unit as said target printhead.

* * * * *